United States Patent [19]

Scheiber et al.

[11] 4,034,703

[45] July 12, 1977

[54] APPARATUS FOR EXTERNALLY COATING ENDLESS METAL TUBING AND LIKE ELONGATED METAL MEMBERS

[75] Inventors: Werner Scheiber, Frankfurt am Main; Herbert Koppe, Langenselbold, both of Germany

[73] Assignee: Metallgesellschaft Aktiengesellschaft, Frankfurt am Main, Germany

[21] Appl. No.: 714,826

[22] Filed: Aug. 16, 1976

[30] Foreign Application Priority Data

Sept. 25, 1975 Germany ..... 2542769

[51] Int. Cl.[2] ..... B05C 19/02

[52] U.S. Cl. ..... 118/35; 118/67; 118/69; 118/405; 118/DIG. 5

[58] Field of Search ..... 118/405, DIG. 5, 404, 118/67, 312, 69, DIG. 11, 35; 427/185

[56] References Cited

U.S. PATENT DOCUMENTS

| | | | |
|---|---|---|---|
| 2,287,825 | 6/1942 | Postlewaite | 118/405 X |
| 3,108,022 | 10/1963 | Church | 118/404 X |
| 3,161,530 | 12/1964 | Strobel | 427/248 X |
| 3,208,868 | 9/1965 | Strobel et al. | 118/312 X |
| 3,589,333 | 6/1971 | Quackenbush | 427/195 X |
| 3,616,983 | 11/1971 | Kamimura et al. | 118/405 X |

*Primary Examiner*—John P. McIntosh
*Attorney, Agent, or Firm*—Karl F. Ross; Herbert Dubno

[57] ABSTRACT

An apparatus for externally coating elongated metal members and, particularly, endless metal tubing with synthetic-resin using a powder-melt process in which the powder is initially fused to the surface of the metal member and concurrently or subsequently caused to coalesce into a coating film. The metal member is passed through a fluidized bed of the synthetic-resin powder after being preheated and the powder is induced to flow along the metal member through an annular nozzle formed on a coating head within the fluidized bed. The powder is advantageously sucked through the coating head and is drawn via the annular nozzle into contact with the metal member.

11 Claims, 3 Drawing Figures

19
1
4
8a
3
5
9
8
α < 90°
l > 10mm

APPARATUS FOR EXTERNALLY COATING ENDLESS METAL TUBING AND LIKE ELONGATED METAL MEMBERS

CROSS REFERENCE TO RELATED APPLICATION

This application is related to the commonly assigned copending application Ser. No. 616,314 (filed Sept. 24, 1975) and to the prior work referred to therein) and issued as U.S. Pat. Nos. 3,965,854 and 3,869,300.

FIELD OF THE INVENTION

The invention relates to an apparatus for externally coating elongated metal members and particularly endless metal tubing with synthetic-resin materials.

BACKGROUND OF THE INVENTION

It is known from the above mentioned application and patents to coat elongated metal members with fusible synthetic-resin material by heating the metal member, bringing it into contact with a fluidized or gas-entrained stream of synthetic-resin particles, thereby bonding the particles in a layer to the metal member, and thereafter causing the synthetic-resin of the particles to flow and coalesce in the formation of a film on the surface of the metal member.

It is known, further, to provide apparatus for externally coating endless metal tubing with synthetic-resin materials by this so-called powder-film coating process, by blowing a turbulent air stream through a vessel containing the power and drawing the elongated metal tubing therethrough after previously heating the metallic surface.

For the continuous coating of round articles such as wire or tubing of small diameter, Austrian Patent 238,349 describes a process in which the round articles are moved through a fluidization bed in a so-called "dip-coating basin" whereupon the adherent layer of powder is reheated to level the synthetic-resin coating. The articles are then cooled in a liquid bath to solidify the synthetic-resin layer.

In practice it has been found that this process cannot be used for a uniform coating of tubes which are relatively large in diameter, e.g. of a diameter of 10 mm or more, because dead zones or wakes are formed on the underside of the tube so that only a smaller amount of the synthetic-resin material can be fritted thereto in these regions. The term "fritted" is used to refer the adhesion of discrete particles of the synthetic-resin to the metallic surface without coalescence of the synthetic-resin.

Austrian patent 310,430 describes a process in which this disadvantage apparently can be eliminated by rotating the tubes to be coated about their axes as they move through the fluidized bed in which they are dip-coated.

Endless tubing, i.e. tubing which fabricated in any conventional plant for the manufacture of metal tubing, cannot be coated by this process because the tube cannot readily be rotated.

Swiss patent 466,103 describes a process whereby a trickling bed, which is vibrated, is used to permit coating of endless tubing which cannot be rotated. However, this bed cannot be used as a practical matter to apply uniform thin coatings to a tube which travels at high speeds since this requires powder having such a small particle size, e.g. 30 to 80 microns, that trickling no longer occurs and is not possible.

Still another process, as described in Austrian patent 323,860, enables an external coating of endless tubing but permits tubing to be coated only when it moves at a velocity below 10 meters per minute. When the tube moves at a higher velocity, the powder-entraining air stream discharged by the annular nozzle and guided onto the tube by a guide vane, sucks additional air from the exit opening for the tube to be coated. This exit opening is disposed beneath the guide vanes so that only a small part of the powder particles contact the heated surface of the tube. Most of the particles are entrained into the annular air exhaust duct. This can be compensated only by providing a distance between the tube inlet and tube outlet in the coating head which is extremely long. Because of the vibration of the tubing to be coated, however, such lengths are not practical and it is found that when they are utilized, vibration of the tubing results in direct contact between the tubing surface coated with the molten material and the surface of the tube or the edge of the tube outlet.

OBJECT OF THE INVENTION

It is the object of the present invention to provide an apparatus which avoids these disadvantages of the state of the art and to provide an apparatus which enables a uniform and firmly adherent, thin coating of synthetic-resin material to be applied to a continuous elongated member which is capable of moving at high velocities, e.g. 100 meter per minute.

SUMMARY OF THE INVENTION

This object, and other which will become apparent hereinafter, is attained, in accordance with the present invention, in an apparatus for the coating of continuously produced elongated metal members, particularly metal tubing which is previously heated, comprising a coating head in a fluidized bed and preferably formed with an annular nozzle through which the particles are inducted to flow from the bed onto the surface of the pipe. The coating head, which surrounds and is traversed by the tubing to be coated, is advantageously provided with means for inducing the flow of powder through the coating head and uniformly along the surfaces of the pipe.

According to a feature of the invention, the fluidized bed is under atmospheric or slightly superatmospheric pressure and supplies the synthetic-resin material which is sucked through the annular nozzle into the coating head and thus into contact with the surface of the tubing to be coated.

The annular nozzle is preferably provided with two or more annular funnels which are arranged one in another and define between them a narrow annular slot having a width of about 10 mm and traversed by the powder induced into the head.

The fitting comprising the two annular funnels preferably has a length of at least 10 mm, advantageously 40 to 80 mm, so that the powder particles are accelerated in the gap to a velocity such that they cannot be entrained by additional air encroaching from the end of the coating head but will reliably contact and are trained upon the surface of the tubing with sufficient kinetic energy to bond thereto as they contact this heated surface.

The funnel-shaped fitting extends toward the powder-entraining air, preferably at an angle of 30° to 60°, most advantageously about 45°, to the axis of the tube to be coated.

According to another feature of the invention, the oating head is followed, along the transport path of he continuously displaced metal tubing, by a liquid ank which contains a leveling liquid heated to a temerature above the melting point of the synthetic-resin naterial. As a result, the film of synthetic-resin mateial on the metal tubing can be leveled even though the ubing is traveling at a high velocity, e.g. equal to or bove 100 meters per minute.

The invention has numerous advantages. For examle, endless tubing can be coated while traveling at elocities up to and above 100 meters per minute, orresponding to the velocities with which tubing can e produced in modern tube-fabrication plants. The eveling means insures the formation of coatings having uniform and smooth external surface. The tube is ormed with a coating of uniform thickness throughout s periphery since wakes or dead spots of the aforenentioned type no longer arise. A special advantage esides in the fact that the tubing need not be rotated as t moves through the coating head. Thus the coatings re highly uniform and adhere particularly firmly to the urface of the tube.

BRIEF DESCRIPTION OF THE DRAWING

The above and other objects, features and advanages of the present invention will become more readily pparent from the following description, reference eing made to the accompanying drawing in which.

SPECIFIC DESCRIPTION AND EXAMPLES

Figure 1:
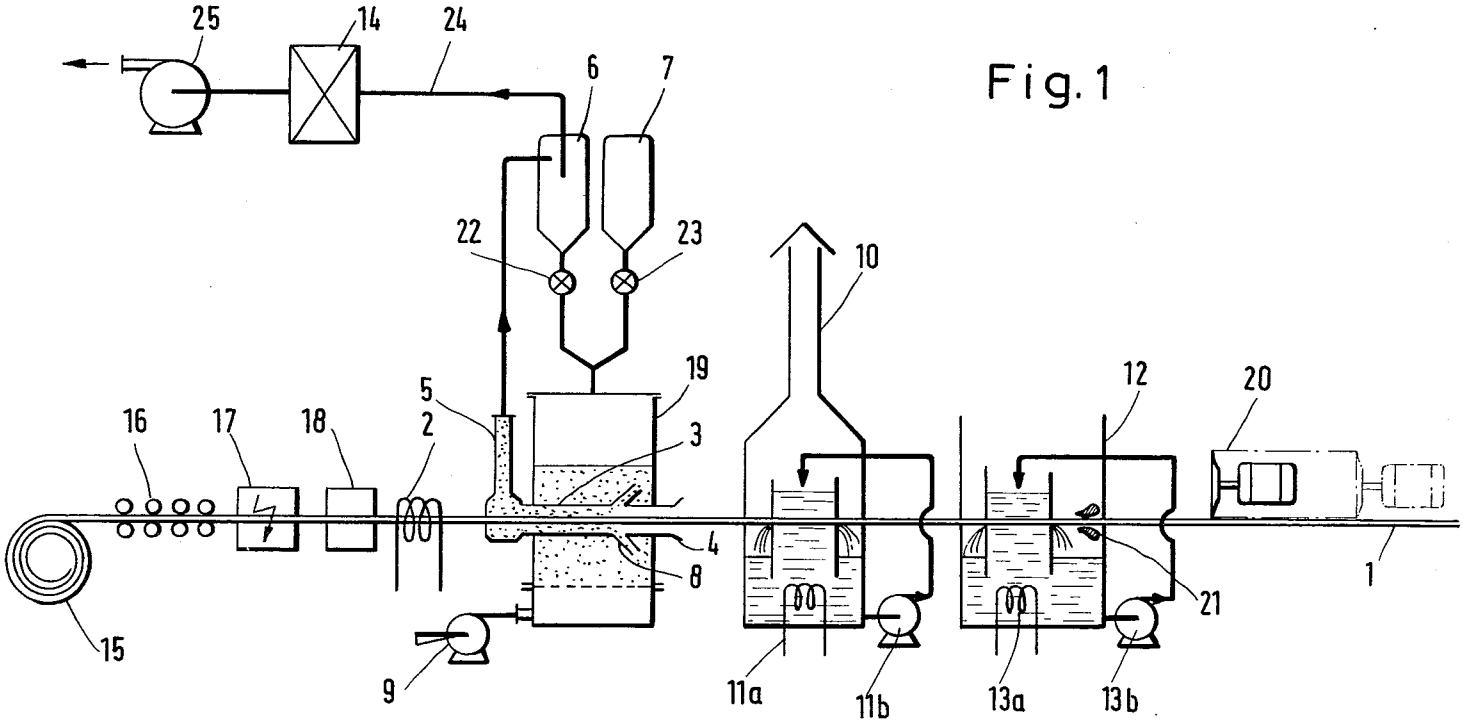
FIG. 1 is a flow diagram showing a plant for the coatng of welded steel tubing according to the invention.
Figures 2, 3:
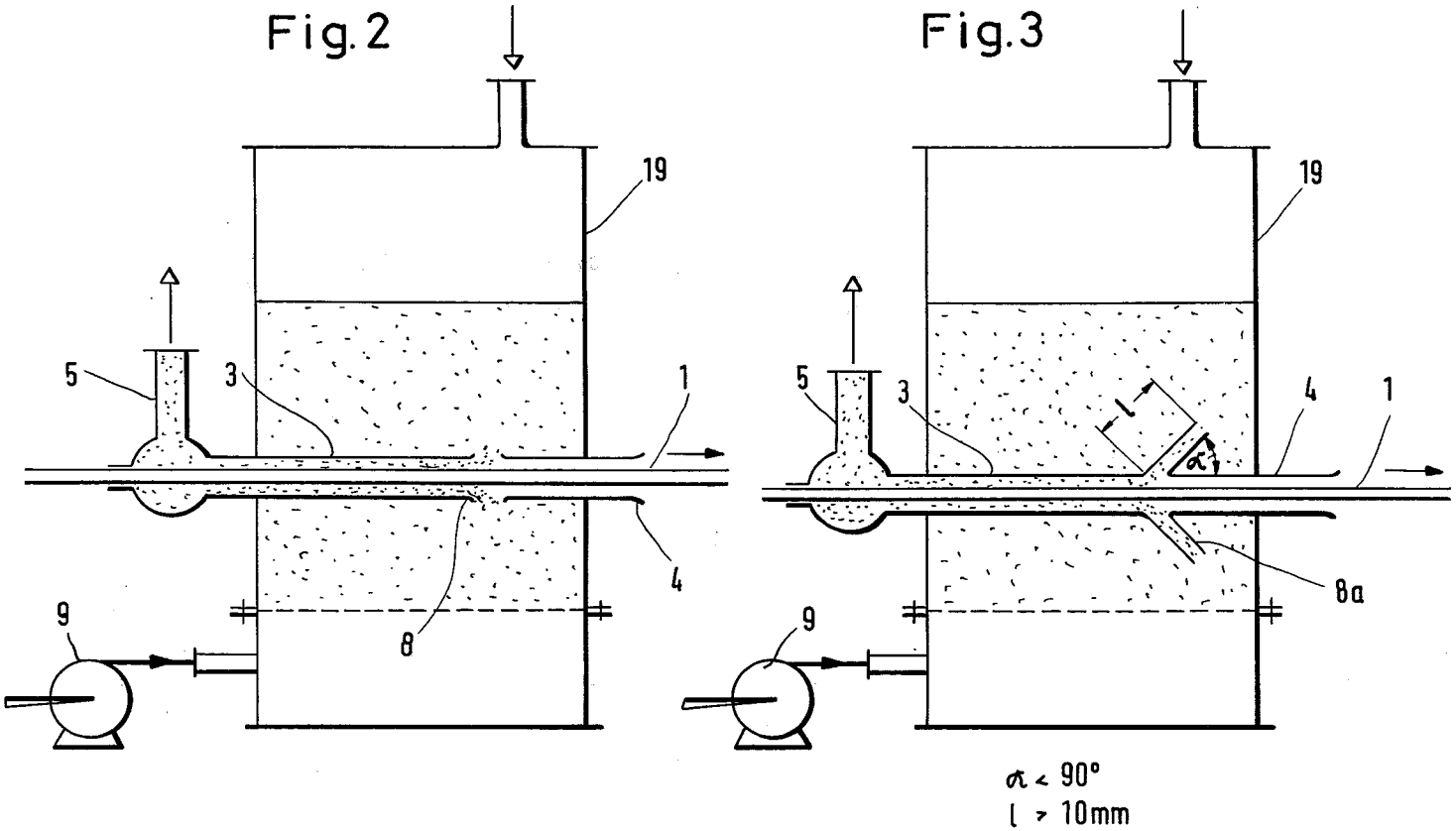
FIG. 2 is a diagram, as seen in vertical cross section, f a portion of a plant with a coating head formed with n annular nozzle according to the invention.
FIG. 3 is a view similar to FIG. 2 of another embodinent thereof.

In the broadest terms, FIG. 1 shows diagrammatically plant for producing welded steel tubing with a coating nit according to the invention and a liquid tank for eveling and cooling the coating which has been aplied. FIG. 2 can be considered to represent a portion f the plant of FIG. 1 as provided with one embodiment f a coating head according to the invention, the annuar nozzle consisting of an annular slot. FIG. 3 shows he plant as provided with an annular nozzle and a oating head but in this case the annular slot is proided with a funnel-shaped fitting as generally decribed previously.

Referring now to FIG. 1 it can be seen that continuus welded steel tubing 1 is produced by forming rollrs 16 and a welded station 17 from coiled strip 15. The lant (15, 16 and 17) for producing the continuous ubing can be a so-called helical-seal welding plant.

The system also can operate with a continuous weldng along a longitudinal seam as desired. The tubing is hen passed into a sand-blasting unit 18 where its exteral surface is subjected to high velocity sand particles clean, descale and, generally, produce a metallically right surface.

When the tubing has thus been cleaned, it traverses a tationary induction coil 2 in which the tubing is heated the coating temperature.

The tubing 1 is next continuously passed through a oating head 3 which is provided with an annular nozle (see FIGS. 2 and 3) and through a suction fitting 5, merging from the coating head 3 through an outlet 4.

The coating head 3 is, according to an essential feature of the invention, disclosed in a fluidized bed 19 of the dip-coating basin type described earlier. The synthetic-resin material is maintained in a fluidized state in the bed 19 by a blower 9. Air and a power-air mixture are sucked by another blower 25 into the coating head 3 through the outlet 4 and the annular nozzle 8, respectively. Powder which has not been consumed by bonding to the surface of the tubing is collected in a cyclone 6 and is recycled into the fluidized bed 19 through a star-type metering device 22.

Air flows through the suction blower 25 from the cyclone 6 through a conduit 24 and a fine filter 14 wherein any particles not recovered in the cycone are removed before the air is released into the atmosphere. The powder collected at the filter 14 can also be recycled to the fluidized bed if desired.

To replace powder consumed in the coating process, fresh powder is fed from a powder bin 7 through a star feeder 23 to the fluidized bed 19.

The steel tubing is uniformly coated with a frit of the synthetic-resin material powder in the coating head 3 and then passes into a leveling bath 10 which is provided with a heater 11*a* and a recirculating pump 11*b* for the liquid, here a leveling oil having a boiling point well above the melting point of the synthetic-resin powder.

The tubing is then passed into a cooling bath 12 which is provided with a cooling coil 13*a*, a coolant recirculating pump 13*b* and a wiper 21 for removing any oil which adheres to the coated tubing. Coated tubing 1 can then be cut to the desired length by a traveling saw 20.

EXAMPLE I

Using the apparatus shown generally in FIG. 1, steel tubing which has an inside diameter of 20 mm and a wall thickness of 2 mm and continuously produced from coil strip steel 15 by means of forming roller 16 and a welder 17 is continuously moved through the sand-blasting unit 18 in which the tubing is provided with a metallically bright surface.

The tubing is then passed through the stationary induction coil 2 and is heated therein to a temperature of 280° C. As the tubing moves through the coating head 3, the blower 25 draws a powder-air mixture through the annular nozzle 8 from the fluidized bed of synthetic-resin powder which is maintained in the chamber 19.

The annular nozzle 8 can consist of only an annular slot as shown in FIG. 2. In this embodiment, the blower 25 draws through the outlet opening 4 and the annular nozzle 8 an air stream at a velocity of 40 meters per second opposite to the direction of travel of the continuously produced tubing 1 (see the arrow in FIG. 2) and causes the air stream to entrain particles against the surface of the tubing.

The fluidized bed 19 consists of polyamide-11 powder with a particle size of 40 to 80 microns. The gas stream entrained along the tubing contains 4 kg of powder per cm.

The coating on the surface of the tube 1 emerges from the outlet 4 of the coating head 3 consisting of incompletely melted and discrete particles. The pipe passes through the leveling bath which is maintained at a temperature of 230° C by the heater 11*a*. The leveling oil consists of high molecular weight paraffin based hydrocarbon which have previously been subjected to hydrogeneration and has a viscosity at 100° C of 30 centistokes = 411° E.

From the leveling bath 10 the tubing 1 is fed into the cooling bath 12 which contains cold oil. Adhering residual oil is wiped from the surface of the tubing by the wiper 21 and the tubing is then cut to lengths by the saw 20.

The resulting coating has a thickness of 160 microns and is highly uniform over the entire surface of the tubing 1. The latter passes through the apparatus at a velocity of 60 meters per minute.

An irregular coating of nonuniform thickness was formed on the tubing when it was displaced at higher velocity.

EXAMPLE II

The same conditions as described were employed as in Example I but the coating head of FIG. 3 was used. In this case the annular nozzle 8 of the coating head was not open radially but was provided with a funnel-shaped fitting 8*a* having a length of 80 mm and inclined at an angle to the tubing of 45° against the direction of displacement thereof.

Thus the powder-entraining air stream was trained on the tubing 1 at this angle. The powder drawn from the fluidized bed was thus strongly accelerated toward the tubing 1 so that it could not be carried by additional air sucked from the outlet end 2 of the coating head. As a result tubing traveling at velocities above 100 meters per minute could be coated with a uniform layer of the same thickness as described with respect to Example 1.

In both embodiments, i.e. in both FIG. 1 and FIG. 2, the coating head 3 was formed externally of the fluidized bed with an enlarged chamber from which the radial fitting 5 was led.

We claim:

1. An apparatus for externally coating an elongated metal member which comprises:

means forming a fluidized bed of a synthetic-resin powder;

means forming a transport path through said bed for said elongated metal member;

means upstream of said bed along said path for heating said member to a temperature sufficient to cause said powder to adhere to the surface of said member;

means forming a coating head in said bed along said member, said coating means having an annular opening communicating with said bed; and means spaced from said opening for applying suction to said head to draw powder from said bed through said head and along said member, thereby coating said member with said powder.

2. The apparatus defined in claim 1 werein said opening is formed as an annular nozzle provided with an annular slot defined by a funnel-shaped fitting having a length of at least 10 mm and adapted to accelerate the powder particles drawn therethrough.

3. The apparatus defined in claim 2 wherein said fitting has a length of 40 to 80 mm.

4. The apparatus defined in claim 2 wherein said funnel-shaped fitting is inclined toward said member at an angle of 30° to 60°.

5. The apparatus defined in claim 4 wherein said angle is about 45°.

6. The apparatus defined in claim 1, further comprising a liquid tank downstream of said heat along said path and traversed by said member, said liquid tank containing a leveling liquid heated to a temperature above the melting point of the synthetic-resin.

7. The apparatus defined in claim 6, further comprising means forming a cooling bath along said path downstream of said tank and traversed by said member for cooling the synthetic-resin coating on said member.

8. The apparatus defined in claim 7 wherein said member is a continuous metal tube, said apparatus further comprising means along said path upstream of said heating means for producing said continuous metal tube.

9. The apparatus defined in claim 7 wherein said head comprises a tube extending through said bed and formed upstream of said bed with a fitting connected to a suction source and downstream of said bed with an outlet through which said tubing emerges.

10. The apparatus defined in claim 8, further comprising cutting means downstream of said cooling means for severing said tube into lengths.

11. The apparatus defined in claim 9 wherein said head is provided with a funnel-shaped fitting defining an annular slot inclined toward said tube against the direction of displacement thereof through said head at an angle of substantially 30° to 60°, said slot having a length of 40° to 80° mm.

* * * * *